US006901032B1

(12) United States Patent
Eo et al.

(10) Patent No.: US 6,901,032 B1
(45) Date of Patent: May 31, 2005

(54) TIMEPIECE FROM WHICH SUNRISE AND SUNSET TIME CAN BE DETERMINED

(75) Inventors: Yoon-hyoung Eo, Seoul (KR); Jang-sung Choi, Gyeonggi-do (KR)

(73) Assignee: Timespace System Co., Ltd., Seoul (KR)

( * ) Notice: Subject to any disclaimer, the term of this patent is extended or adjusted under 35 U.S.C. 154(b) by 0 days.

(21) Appl. No.: 09/980,640

(22) PCT Filed: Jun. 17, 1999

(86) PCT No.: PCT/KR99/00309

§ 371 (c)(1),
(2), (4) Date: Apr. 11, 2002

(87) PCT Pub. No.: WO00/77578

PCT Pub. Date: Dec. 21, 2000

(30) Foreign Application Priority Data

Jun. 16, 1999 (KR) ..... 1999/22609

(51) Int. Cl.[7] ..... G04B 49/00; G04B 19/26
(52) U.S. Cl. ..... 368/15; 368/17; 368/27
(58) Field of Search ..... 368/15–20, 21–27

(56) References Cited

U.S. PATENT DOCUMENTS 4,435,640 A * 3/1984 Micheletto ..... 235/78 M
4,551,027 A * 11/1985 Spruck ..... 368/15
4,759,002 A * 7/1988 Cash ..... 368/15
5,023,849 A * 6/1991 Vaucher ..... 368/15
5,253,225 A * 10/1993 Vaucher ..... 368/20
5,631,878 A * 5/1997 Chen ..... 368/21

FOREIGN PATENT DOCUMENTS

DE 43 39 220 A1 5/1995

* cited by examiner

*Primary Examiner*—Vit W. Miska
(74) *Attorney, Agent, or Firm*—Staas & Halsey LLP

(57) ABSTRACT

Disclosed is a timepiece from which a sunrise and sunset time along with the position of the sun can be determined. The sunrise time and the sunset time are changed according to the season and the latitude of the place where one man the time. People acquire the sunrise and sunset time from the news of a television or a newspaper. According to the enlargement of cities, underground activities and the degree of building closure are increased to shield the sun. The timepiece of the present invention comprises a circular hour plate which rotates once per 24 hours. Also included is a sunrise and sunset time designating section (21) for indicating the sunrise time and the sunset time for each month. Through the timepiece of the present invention, the present time, the position of the sun at the present time, the sunrise and sunset time can be appreciated. In particular, the external state of the day or night can be easily distinguished by the people in the underground and in a closed building, through using the timepiece of the present invention.

8 Claims, 5 Drawing Sheets

TIMEPIECE FROM WHICH SUNRISE AND SUNSET TIME CAN BE DETERMINED

BACKGROUND OF THE INVENTION

1. Field of the Invention

The present invention relates to a timepiece from which a sunrise and sunset time can be determined, and more particularly to a timepiece from which a sunrise and sunset time and the position of the sun at a specific place at the present time for a specific month can be determined by providing an hour hand which rotates once per 24 hours and a fixed plate or a rotating plate for designating a sunrise and sunset time with the timepiece.

2. Description of the Prior Art

Various kinds of time units are used according to a period and a region. For example, the presently used 24-division per day system was employed only before 100 years in the Orient. Before that, 12-division per day system, that is, 12-cycle (12-gabja in Korean) system had been used. When necessary, 100-division per system could be used. Recently, an internet time which is 1000-division per day system, has been suggested as the internet, the worldwide communication system is actively implemented in the world. However, the 24-division per day system, that is, 24-hour system is definitely fixed for the present time system. The timepiece for indicating the time includes a 12-divisional plate and an hour hand which rotates twice per day.

Nowadays, the widely used system of the date is the solar calendar which directly reflects the moving state of the sun around the earth. That is, one day is obtained from the time of one due culmination to the next due culmination at a specific place. One day is divided into 24 hours and one hour is divided into 60 minutes. One year is obtained by measuring the time from the starting point to the next returning point to the starting point at a specific place on the ecliptic. The widely used calendar is the solar calendar and the timepiece is the system of the solar time system. A season and day and night can be determined through the relation of the sun and the earth. Therefore, a lot of the living period coincides with the system of the solar time system. However, most of the timepiece is 12 hour system of which hour hand rotates once per 24 hours for indicating the present time and so, the natural phenomenon such as the present position of the sun, the attitude and day and night can not be designated by the solar time system. This may break the natural band between nature and a human being.

When assuming that the culmination time of the sun in Republic of Korea is 12 o'clock (since the standard meridian line in Republic of Korea, is the east longitude of 135, the real culmination time is 12 o'clock 30 minutes), the sun rises from the due east and sets to the due west on vernal equinox day and autumnal equinox day. The sunrise time on these days is 6 o'clock a.m. while the sunset time is 6 o'clock p.m. On summer shoot, the sun rises from the northeast and sets to the northwest and the sunrise time is about 4 o'clock 40 minutes a.m. and the sunset time is about 7 o'clock 20 minutes p.m. Therefore, the day time on the summer shoot is longer by about 2 hours and 40 minutes than that on the vernal equinox day or autumnal equinox day. On the winter solstice, the sun rises from the southeast and sets to the southwest and the sunrise time is about 7 o'clock 20 minutes a.m. and the sunset time is about 4 o'clock 40 minutes p.m. Therefore, the day time on the winter solstice is shorter by about 5 hours and 20 minutes than that on the vernal equinox day or autumnal equinox day, while the night time on winter solstice is longer by the same length.

The sunrise time and the sunset time are different from day to day and the difference is accumulated to become about 30 minutes every month.

The sunrise time and the sunset time are changed according to a season and the latitude of the place where the man measures the times.

Even though the sunrise time and the sunset time are very important information in daily life, this information could not be easily obtained without taking a look on the news from a television or a newspaper.

In addition, the enlargement of the urbanization brings about the increased underground activities and the activities in closed buildings, and so most of the people could not see the sun in the actual circumstance.

SUMMARY OF THE INVENTION

Accordingly, it is an object of the present invention to solve the above-mentioned problems and to provide a timepiece for determining the sunrise time and the sunset time and the position of the sun at the present time for a specific place and for a specific month, through including an hour hand which rotates once per 24 hours, and a fixed plate or a rotating plate for designating the sunrise and sunset time.

The object of the present invention can be accomplished by a timepiece comprising an hour hand which rotates once per 24 hours, and a bottom plate which is provided with a sunrise and sunset time designating section for designating a scale corresponding to a sunrise and sunset time for each month.

The timepiece of the present invention can further comprise a minute hand which rotates once per hour.

The shape of the hour hand can be the common shape and the hour hand can include a design symbolizing the sun.

BRIEF DESCRIPTION OF THE DRAWINGS

The above object and advantages of the present invention will become more apparent by describing in detail preferred embodiments thereof reference to the attached drawings in which.

DETAILED DESCRIPTION OF THE INVENTION

Hereinafter, preferred embodiments of the present invention will be explained in more detail with reference to the accompanying drawings.

Figure 1:
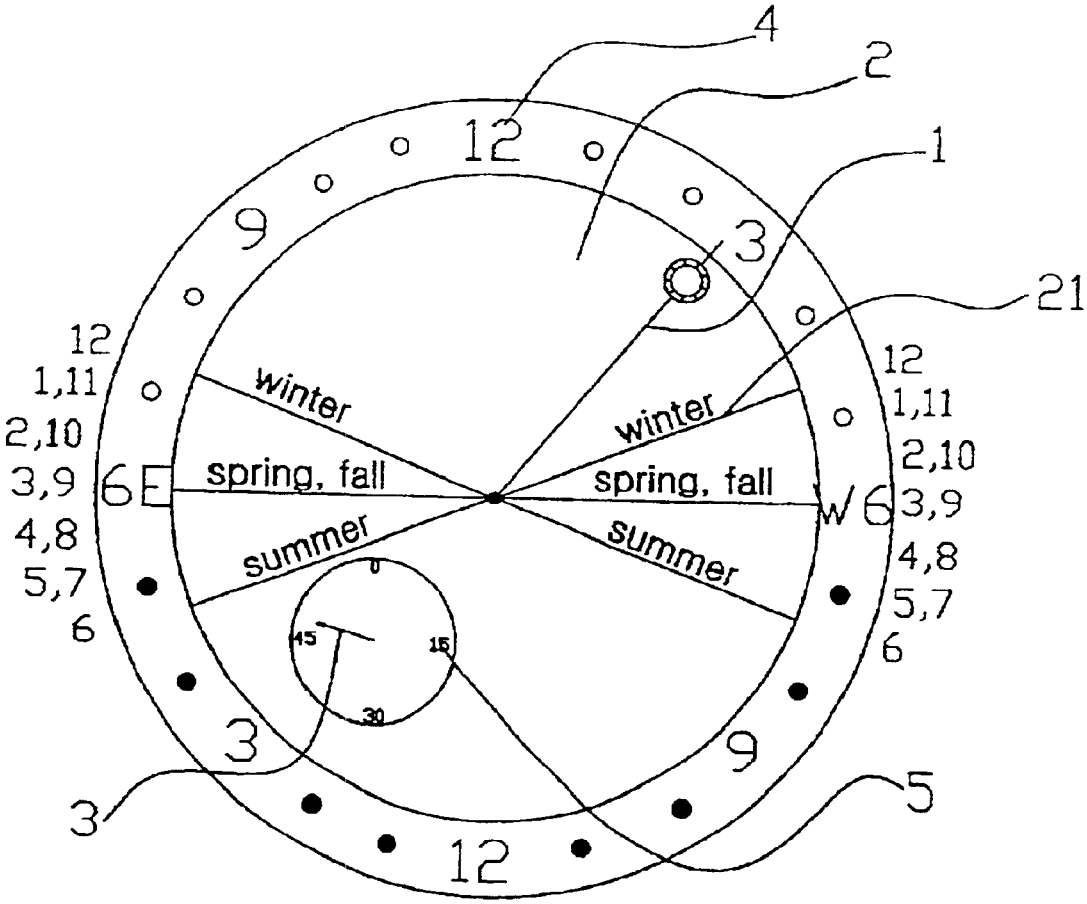
FIG. 1 is a planar view of an embodiment according to the present invention.
Figure 2:
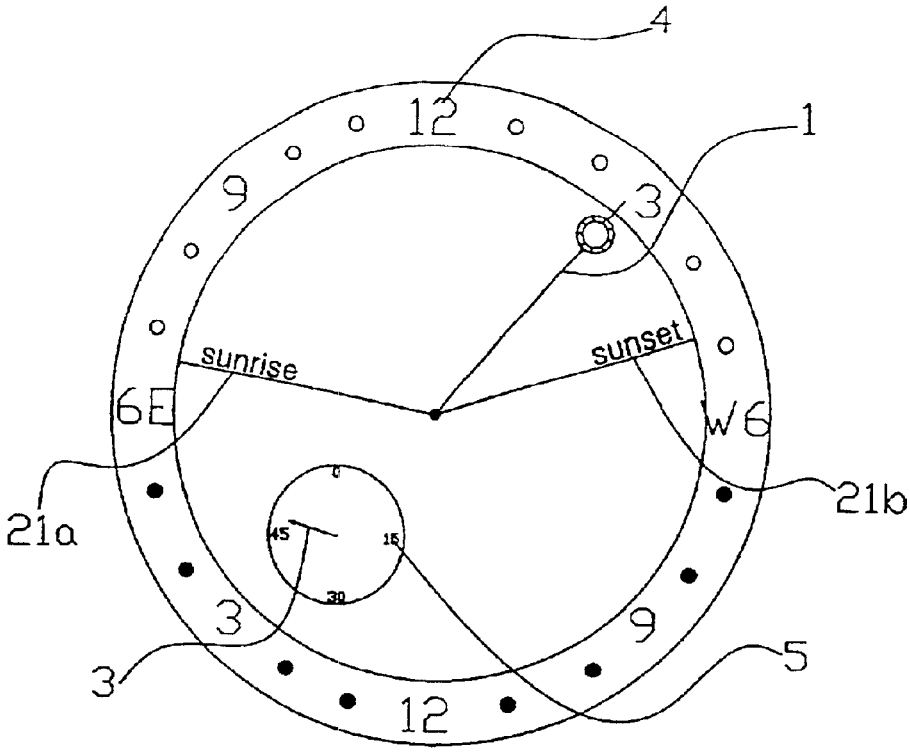
FIG. 2 is a planar view of a bottom plate according to an embodiment of the present invention.
Figure 3:
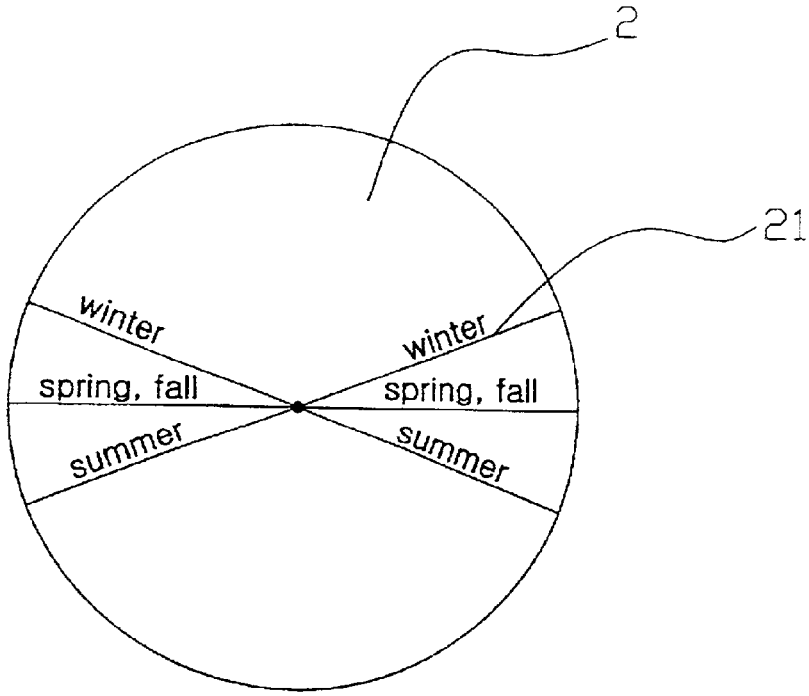
FIG. 3 is a planar view of another embodiment according to the present invention.

Referring to FIGS. 1 & 2, an hour scale 4 can be represented by designating the numerals from 1 to 24, by designating the numerals from 1 to 12 for representing ante meridian hours and continuously the numerals from 1 to 12 for representing post meridian hours or by designating the numerals of 3, 6, 9 and 12 with '0' or specific mark for the remaining intermediate numerals.

The numerals corresponding to the ante meridian hours and the numerals corresponding to the post meridian hours can be designated in different brightness or color saturation for an easy notice. Or the brightest numeral may be positioned at the noon and the numerals from the noon to midnight may be gradually darkened and the numerals from the midnight to the noon may be gradually brightened again.

Preferably, hour scale 4 can optionally rotate in order to adjust the time when daylight saving time is applied.

The rotation of hour hand 1 can be a continuous analog-type rotation or a digital-type rotation in which hour hand 1 rotates by one scale per hour.

The rotational axis of minute hand 3 can be the same with that of hour hand 1 and can be placed at a predetermined position on the bottom plate.

On a minute scale 5 of the present invention, minutes can be indicated by the numerals of 0, 10, 20, . . . 50 or by the numerals of 0, 15, 30 and 45, as occasion needs.

The rotational directions of hour hand 1 and minute hand 2 can be optionally determined. When each hand rotates counterclockwise, the order of the designating numerals of hour hand 1 and minute hand 3 should be clockwise.

Bottom plate 1 having a sunrise and sunset time designating section 21, is fixed. The angle between sunrise and sunset designating section 21 and a horizontal line (the line connecting common 3 o'clock direction with 9 o'clock direction) is different depending on its latitude. That is, the designating section 21 will approach the horizontal line at low latitude, while become more distant from the horizontal line at high latitude. The same sunrise and sunset designating section 21 can be used within Republic of Korea. However, a different timepiece having a different sunrise and sunset designating section 21 is needed for foreign countries such as USA, Russia, China, Japan and the like of which territory is wide or the shape of the territory is long from south to north.

When the standard meridian line in Korea is 127.5 (actually, east longitude of 135), and when numeral 12 of hour scale 4 coincides with hour hand 1, it means that the sun is culminated and the rotation of hour hand 1 is the same with the rotation of the sun. Accordingly, a red dot can be drawn as the symbol of the sun or a taegeug design or a star can be drawn for indicating the position of the sun at a specific time.

Utilizing the timepiece having the above-mentioned constitution, the present time and the position of the sun can be recognized by the common method. That is, when hour hand 1 is positioned on the common 12 o'clock direction, the sun is culminated, when positioned above the connecting line of sunrise and sunset time designating section 21 (in case of May, the connecting line of May in the left portion of the sunrise and sunset time designating section and the center point of the timepiece and the connecting line of May in the right portion of the sunrise and sunset time designating section and the center point of the timepiece), the sun is in the state of floating in the sky and when positioned below the connecting line, the sun is below the horizontal line. When hour hand 1 is on the connecting line of the month, the sun is in sunrise or sunset state.

The object of the present invention also can be accomplished by a timepiece from which the sunrise time and the sunset time and the position of the sun can be determined, the timepiece comprising an hour hand 1 which rotates once per 24 hours; a sunrise time designating plate 2*a* including a sunrise time designating section 21*a* having scales for indicating the sunrise time; and a sunset time designating plate 2*b* including a sunset time designating section 21*b* having scales for indicating the sunset time. One of sunrise time designating plate 21*a* and sunset time designating plate 21*b* can rotate optionally. And the other plate rotates to the counter direction of the first plate while keeping the interlocking state with the first plate.

The timepiece of the present invention can further include minute hand 3 which rotates once per hour.

The shape of hour hand 1 can be the common shape and hour hand 1 can include a design symbolizing the sun.

Figure 4:
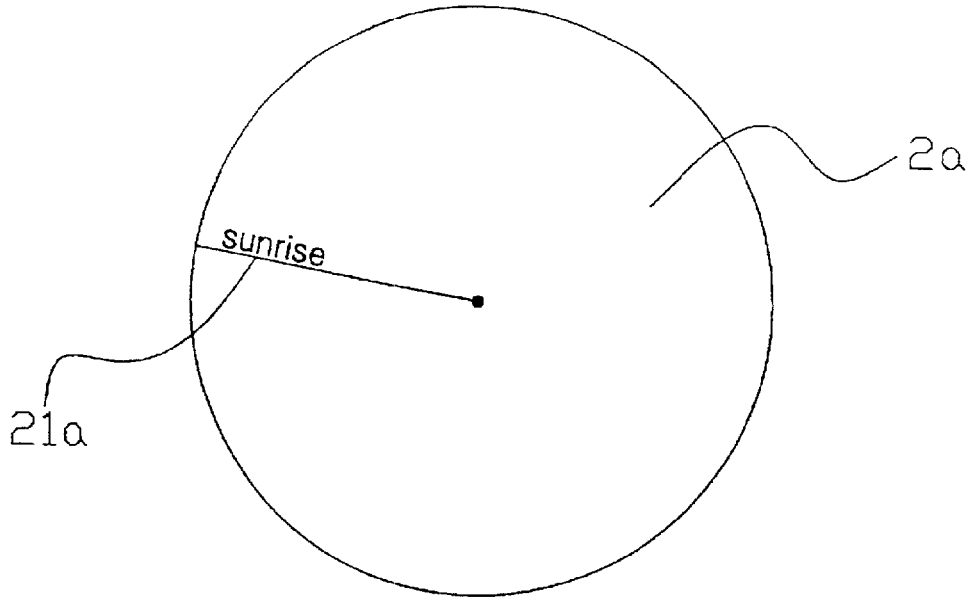
FIG. 4 is a planar view of a sunrise time designating plate according to another embodiment of the present invention.
Figure 5:
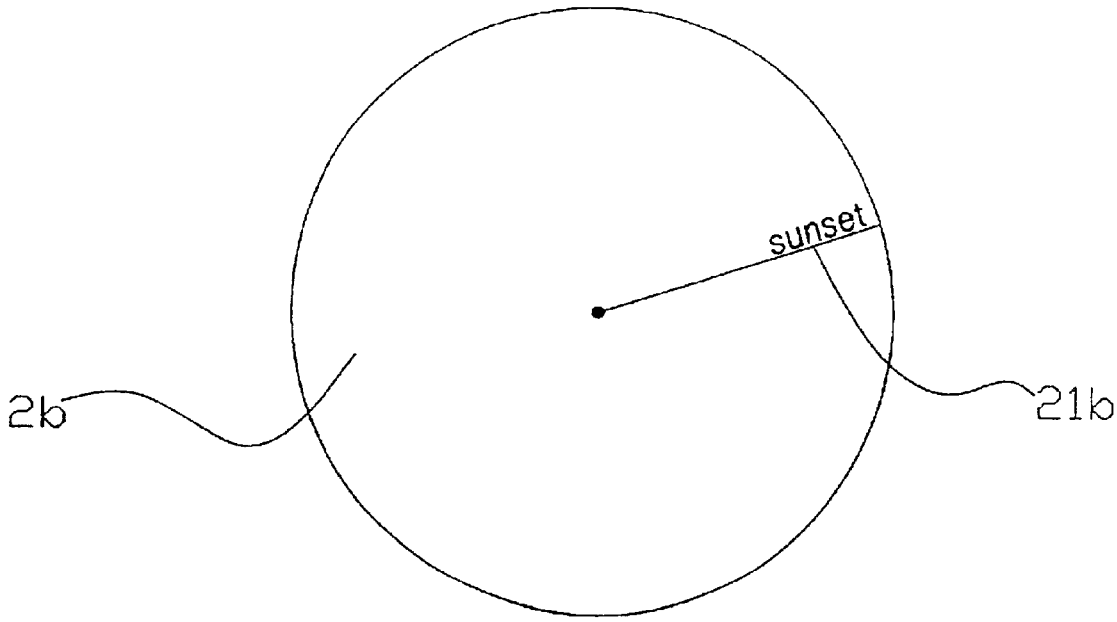
FIG. 5 is a planar view of a sunset time designating plate according to another embodiment of the present invention.

Sunrise time designating plate 2*a* and sunset time designating plate 2*b* can be manufactured by drawing a line from each center point to the end portion of each plate or by designating marks at the end portion of each plate for indicating the sunrise time and the sunset time. More preferably, the characters of the sunrise or sunset, or the sunrise time or sunset time may be designated on a predetermined position of each plate as shown in FIGS. 4 & 5.

One of sunrise time designating plate 2*a* and sunset time designating plate 2*b*, is manufactured for optionally rotating by a manual operation while manufacturing the remaining plate rotating to the counter direction of the first plate and keeping the interlocking state with the first plate. At a predetermined position on the two plates, on the glass cover, on the case and the like, a guide for the manual operation can be indicated for the optional rotation by the manual operation. Since the time from the sunrise to the culmination and the time from the culmination to the sunset during a day, is the same, it is preferred that the two plates keep the interlocking state with each other for accomplishing a minuter operation. Of course, the two plates can be operated by different manual operations without keeping the interlocking state.

Through utilizing the timepiece having the above-described constitution according to the present invention, the present time, the position of the sun at the present time, the sunrise time and the sunset time, can be appreciated. In particular, the external state such as the bright state of day or the dark state of night, can be easily achieved even in the underground city and in a closed space by using the timepiece of the present invention.

In order to realize the directions of sunrise and sunset on the timepiece, in the timepiece of the present invention, it is preferred to make indicators, for example, "E" and "W", at the hour scales of AM6 and PM 6, respectively.

Although the preferred embodiments of the invention have been described only for the structure and the rotational velocity of each plate, it is understood that the present invention should not be limited to the preferred embodiments, but various changes and modifications can be made by one skilled in the art within the spirit and scope of the invention as hereinafter claimed. That is, the timepiece of the present invention can be operated by a mechanical manner through the combination of a driving apparatus and sawtooth having a predetermined rotating ratio. Further the recognition of the data from the timepiece of the present invention can be implemented through an electronic manner using a display device such as an LCD (liquid crystal display device) or a CRT (cathod ray tube).

EFFECT OF THE INVENTION

Through utilizing the clock having the above-described constitution according to the present invention, the present time, the position of the sun at the present time, the sunrise time and the sunset time, can be appreciated. In particular, the external state such as the bright state of day or the dark state of night, can be easily achieved even in the underground city and in a closed space by using the clock of the present invention.

What is claimed is:

1. A timepiece for indicating a sunrise and sunset time and a position of the sun comprising:

an hour hand which rotates once per 24 hours; and a bottom plate including a sunrise and sunset time designating section for designating a scale corresponding to said sunrise time and said sunset time for each month, the hour hand respectively corresponding to the sunrise and sunset time designating sections at the sunrise and sunset times.

2. A timepiece according to claim 1, comprising a minute hand which rotates once per hour.

3. A timepiece according to claim 1, wherein said hour hand includes a design symbolizing the sun.

4. A timepiece for indicating a sunrise and sunset time and a position of the sun comprising:

an hour hand which rotates once per 24 hours;

a sunrise time designating plate including a sunrise time designating section having a scale for indicating said sunrise time; and a sunset time designating plate including a sunset time designating section having a scale for indicating said sunset time, one of said sunrise time designating plate and said sunset time designating plate in rotation, with the other plate in rotation to a counter direction to said first plate while keeping an interlocking state with said first plate.

5. A timepiece according to claim 4, comprising a minute hand which rotates once per hour.

6. A timepiece according to claim 4, wherein said hour hand includes a design symbolizing the sun.

7. A timepiece comprising:

a hand to rotate once per 24 hours; and a plate including a line corresponding to a sunrise time or a sunset time for a current month, the hand being aligned with the line at the sunrise time or the sunset time.

8. A timepiece comprising:

a first plate having a scale to indicate a sunrise time;

a second plate having a scale to indicate a sunset time to interlock with the first plate, wherein the first and second plates rotate relative to each other; and a hand opposite the first or the second plate to rotate once per 24 hours.

* * * * *